US008002402B2

(12) United States Patent
Miyauchi

(10) Patent No.: US 8,002,402 B2
(45) Date of Patent: Aug. 23, 2011

(54) RECORDING APPARATUS

(75) Inventor: Yasuo Miyauchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 12/475,964

(22) Filed: Jun. 1, 2009

(65) Prior Publication Data

US 2009/0302526 A1 Dec. 10, 2009

(30) Foreign Application Priority Data

Jun. 9, 2008 (JP) ..... 2008-150478

(51) Int. Cl.
*B41J 2/01* (2006.01)

(52) U.S. Cl. ..... 347/104; 271/163

(58) Field of Classification Search ..... 271/162, 271/163; 347/104, 164
See application file for complete search history.

(56) References Cited

U.S. PATENT DOCUMENTS

| | | | | |
|---|---|---|---|---|
| 5,128,727 | A | 7/1992 | Miyauchi et al. | 355/308 |
| 5,177,547 | A | 1/1993 | Kanemitsu et al. | 355/321 |
| 5,808,647 | A | 9/1998 | Kurata et al. | 347/104 |
| 7,243,915 | B2 * | 7/2007 | Wong et al. | 271/3.14 |
| 7,591,552 | B2 * | 9/2009 | Takeshita et al. | 347/104 |
| 7,651,087 | B2 * | 1/2010 | Miyashita et al. | 271/163 |
| 2007/0040887 | A1 * | 2/2007 | Miyashita et al. | 347/104 |
| 2007/0058025 | A1 * | 3/2007 | Miyake et al. | 347/104 |
| 2007/0058026 | A1 * | 3/2007 | Miyake et al. | 347/104 |
| 2009/0295896 | A1 * | 12/2009 | Komuro et al. | 347/104 |
| 2009/0295897 | A1 * | 12/2009 | Komuro et al. | 347/104 |
| 2009/0322844 | A1 * | 12/2009 | Komuro et al. | 347/104 |
| 2010/0085407 | A1 * | 4/2010 | Takeshita | 347/104 |

FOREIGN PATENT DOCUMENTS

| | | |
|---|---|---|
| JP | 2003-104590 | 4/2003 |
| JP | 2003-112458 | 4/2003 |
| JP | 2003-212364 | 7/2003 |
| JP | 2006-192596 | 7/2006 |
| JP | 2007-69578 | 3/2007 |

* cited by examiner

*Primary Examiner* — Kaitlin S Joerger
(74) *Attorney, Agent, or Firm* — Fitzpatrick, Cella, Harper & Scinto

(57) ABSTRACT

A recording apparatus has a media tray on which a recording medium is mounted, and which has a rib along an inserting direction into a main body of the recording apparatus, the rib being formed on an opposite surface of the media tray to the recording medium; a feed tray on which the media tray is set, and which has a groove along the inserting direction, the groove being engageable with the rib; and a regulating member which regulates a height from the feed tray when the media tray is inserted into the main body of the recording apparatus. The regulated height is a height that prevents the insertion of the media tray into the main body of the recording apparatus in a state where the rib of the media tray does not engage with the groove of the feed tray.

6 Claims, 11 Drawing Sheets

RECORDING APPARATUS

BACKGROUND OF THE INVENTION

1. Field of the Invention

The present invention relates to a recording apparatus in which is inserted, from a tray located on the front of the apparatus, a media tray on which a recording medium is set, and which recording apparatus can record onto the recording medium with a recording head.

2. Description of the Related Art

A recording apparatus that records onto a recording medium by use of a recording head and based on image information typically has a structure in which the recording medium fed from a feeding means is conveyed to an image forming unit and, after recording is performed by the image forming unit, output from an output means. In the recording apparatus, when recording onto a thick recording medium such as board or onto a storage medium such as a CD-R mounted on a disc tray, the recording is performed while conveying through a flat path which is a flat conveying path different from a conveying path of a normal recording medium. Moreover, a feed/output tray that serves as both a feed tray and an output tray is used in the case of recording through the flat path.

Japanese Patent Application Laid-Open No. 2003-104590 (hereafter referred to as Patent Document 1) discloses a recording apparatus that records onto a thick recording medium by providing a substantially horizontal conveying path with a removable feed/output tray. Meanwhile, Japanese Patent Application Laid-Open No. 2007-069578 (hereafter referred to as Patent Document 2) discloses a structure in which a user changes a position of an output tray to form a substantially horizontal conveying path for thick medium conveyance.

In Patent Document 1, the feed/output tray is removable, which causes a trouble of housing the feed/output tray when not in use. Besides, recording mode settings need to be switched every time between the case of recording onto a storage medium such as a CD-R using a disc tray and the case of recording onto a recording medium wider than the disc tray. This raises the possibility that a problem such as an apparatus failure occurs due to an operational error. In Patent Document 2, on the other hand, even when the same flat path is used for recording, it is necessary to use different feed trays in the case of recording onto a storage medium mounted on a disc tray and in the case of recording onto a recording medium such as thick recording paper. Accordingly, Patent Document 2 has problems of a complicated operation and a cost increase caused by an increased number of components.

The present invention was conceived in view of these technical problems. An object of the present invention is to provide a recording apparatus including a feed/output tray that can be used, with no need for removal, both in the case of recording using a disc tray on which a recording medium is set and in the case of recording without using the disc tray.

SUMMARY OF THE INVENTION

The present invention relates to a recording apparatus including: a media tray on which a recording medium is mounted, and which has a rib along an inserting direction into a main body of the recording apparatus, the rib being formed on an opposite surface of the media tray to the recording medium; a feed tray on which the media tray is set, and which has a groove along the inserting direction, the groove engaging with the rib; and a regulating member which regulates a height from the feed tray when the media tray is inserted into the main body of the recording apparatus, wherein the regulated height is a height that prevents the insertion of the media tray into the main body of the recording apparatus in a state where the rib of the media tray does not engage with the groove of the feed tray.

Further features of the present invention will become apparent from the following description of exemplary embodiments with reference to the attached drawings.

DESCRIPTION OF THE EMBODIMENTS

Figure 1:
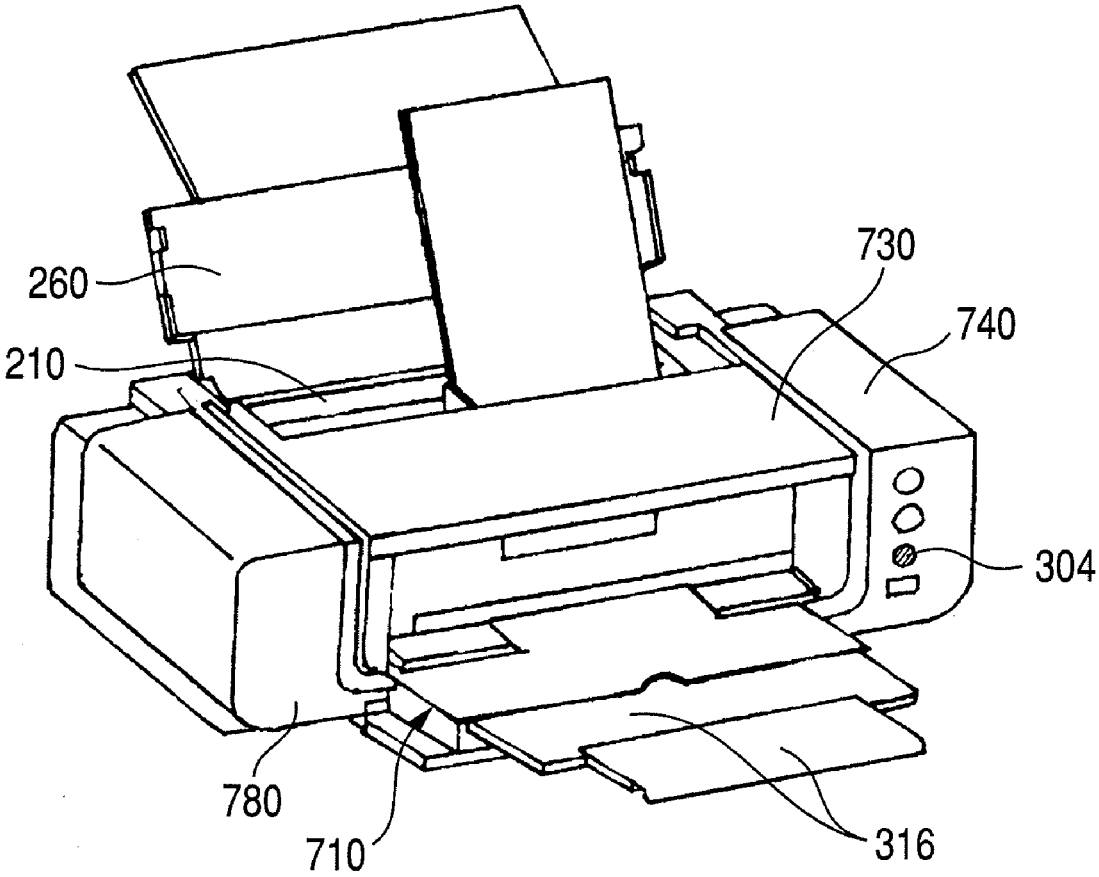
FIG. 1 is a perspective view of a recording apparatus when recording onto a recording medium fed from a feeding means.
Figure 2:
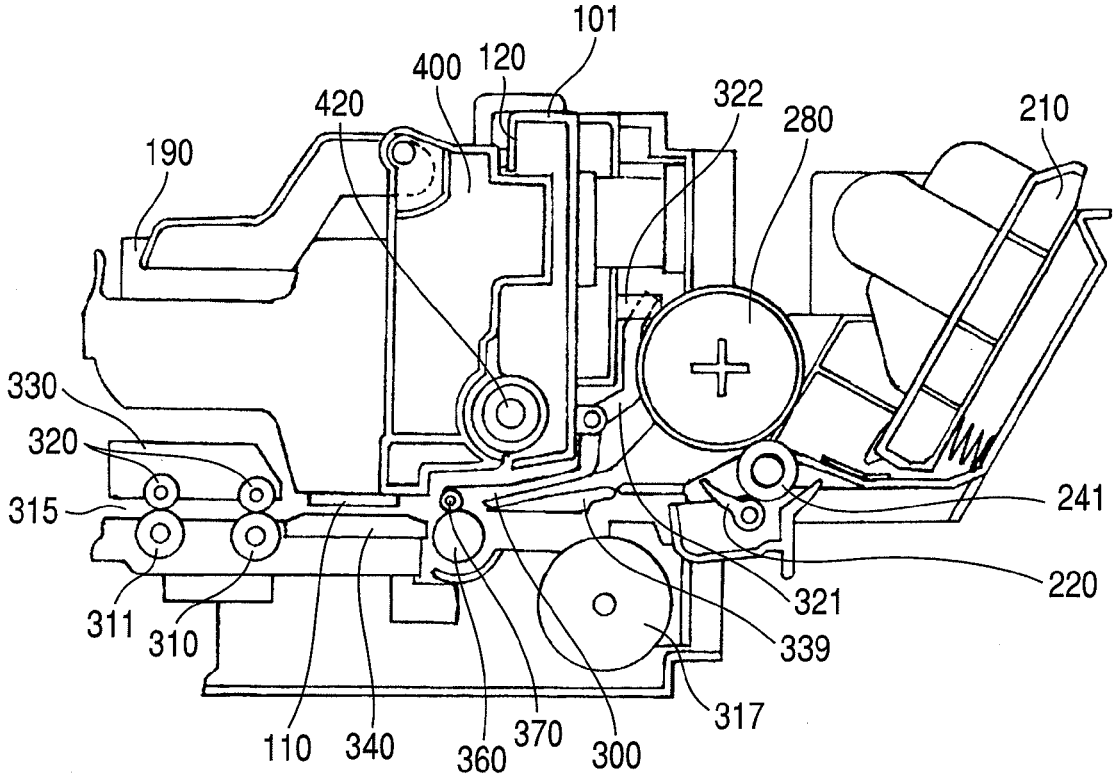
FIG. 2 is a longitudinal sectional view illustrating a structure of the recording apparatus.

Embodiments of the present invention are described below. Note that the same reference signs indicate the same or corresponding parts throughout the drawings.

First Embodiment

A recording apparatus to which the present invention is applied is described below, with reference to FIGS. 1 to 4. The recording apparatus is an apparatus that records an image onto a recording medium by a recording head based on image information. A recording apparatus according to this embodiment includes a feeding unit that constitutes a feeding means, a conveying unit that constitutes a conveying means, an output unit that constitutes an output means, and an image forming unit that constitutes a recording means. These units are covered with an outer covering unit. In addition, a flat path which forms a flat conveying path for conveying, through the image forming unit, a thick recording medium such as board or a disc tray on which a storage medium (recording medium) such as a CD-R is set is formed inside the recording apparatus. The outer covering unit includes a lower case 780, an upper case 740, and an access cover 730. A feed/output tray 710 that forms a front cover in a closed state is installed on the front of the apparatus. The feed/output tray 710 is movable between a position of closing an output opening of the output means and a position of opening the output opening of the output means. The access cover 730 is attached to the upper case 740 so as to be openable and closable. By opening the access cover 730, an ink tank 190 and a recording head 110 can be replaced. The feeding means composed of an automatic paper feeder is provided on the back of the apparatus, and a feed tray 260 of the feeding means is attached to a back portion of the upper case 740 so as to be openable and closable. When not in use, the feed tray 260 serves as part of the outer covering unit.

The feeding means is formed by attaching a feeding roller 280, a pressure plate 210, a separating roller 241, a returning lever 220, and the like to a base 200. The feeding roller 280 feeds a recording medium set on the feed tray 260. The pressure plate 210 presses the recording medium against the feeding roller 280. The separating roller 241 separates and feeds each sheet of recording medium in conjunction with the feeding roller 280. The returning lever 220 returns an excess recording medium sent to the feeding roller 280, back to a set position.

The conveying unit includes a conveying roller 360 for conveying the fed recording medium through the image forming unit, and a pinch roller 370 that is rotated when pressed by the conveying roller 360. The pinch roller 370 is held by a spring-biased, swingable pinch roller holder 300. A PE (paper end) sensor lever 321 and a PE sensor 322 for detecting a front end and a back end of the recording medium are provided in the conveying unit. A guide flapper 339 serving as an entrance of the conveying unit is located on a conveyance upstream side of the conveying roller 360.

The image forming unit which records an image onto the recording medium by the recording head 110 is formed on a conveyance downstream side of the conveying roller 360. A platen 340 for supporting the recording medium is disposed in the image forming unit. A code wheel for detecting a conveyance amount is fixed on a shaft of the conveying roller 360. The conveyance amount by the conveying roller 360 and the position of the recording medium can be detected by reading markings on the code wheel using a code sensor.

The output means constitutes the output unit that outputs the recorded recording medium from the front of the apparatus, and includes a first output roller 310 and a second output roller 311. The first output roller 310 and the second output roller 311 are driven synchronously with the conveying roller 360, by a conveying motor 320. Conveying power is generated by pressing the spurs 320 pivotally supported by a spur holder 330, against the output rollers 310 and 311. Each spur 320 is swingably attached to the spur holder 330 via a rodlike spring, and pressed against the output roller 310 or 311 by spring bias. In the illustrated example, the output recording medium is held on the feed/output tray 710 which is set at a lower position than an output opening 315. In this embodiment, the recording medium is output on a tray plate 316 pulled from the feed/output tray 710.

The image forming unit constituting the recording means includes a carriage 400 that carries the recording head 110 and is movable in a width direction of the recording medium. Each color ink tank 190 is replaceably attached to the recording head 110. The carriage 400 can reciprocate along a guide shaft 420 and a guide rail 120, and is driven by a carriage motor. In addition, the carriage 400 can be moved up and down by vertically moving the guide shaft 420 with respect to a chassis 101 by a cam mechanism. The up and down movement of the carriage 400 enables a gap between the recording head 110 and the recording medium to be adjusted.

A position of the recording head 110 on the carriage 400 in a main scanning direction is detected by reading an encoder scale with an encoder sensor on the carriage. A substrate on the carriage 400 and a main substrate of the apparatus are electrically connected via a flexible cable. The carriage 400 carries a position detecting sensor composed of a reflective photosensor for detecting the position of the recording head 110 relative to the recording medium. For example, the position detecting sensor is used to detect the position of the recording head or the position of the recorded image when recording onto a storage medium set on the disc tray and conveyed.

In the recording apparatus according to this embodiment, a flat path that forms a flat conveying path extending from the output means on the front of the apparatus to the inside of the apparatus is provided. A conveying path from the automatic paper feeder (feeding means) disposed at an upper portion of the back of the apparatus to the pinch roller 370 is curved, and so a recording medium is fed in a curved state. Accordingly, when trying to feed, from the feeding means, an inflexible recording medium like a thick recording medium of no less than about 0.5 mm or a disc tray on which a storage medium such as a CD-R is set, a conveyance resistance increases due to a reaction force of the bent recording medium, as a result of which the feeding may become impossible. Besides, even when the recording medium can be fed, the recording medium may become deformed or broken. In view of this, the flat path which is entirely made up of a flat conveying path is provided in order to record onto a thick recording medium, a recording medium which the user does not want to bend, and a recording medium such as a CD-R which cannot be bent (including a recording medium set on the disc tray). A recording operation of inserting a recording medium from the front of the apparatus into the flat path and recording onto the recording medium by the recording head when the recording medium is conveyed in a direction opposite to the inserting direction is referred to as flat path recording. On the other hand, an operation of recording onto a recording medium fed from the feeding means is referred to as normal recording.

Figure 5A:
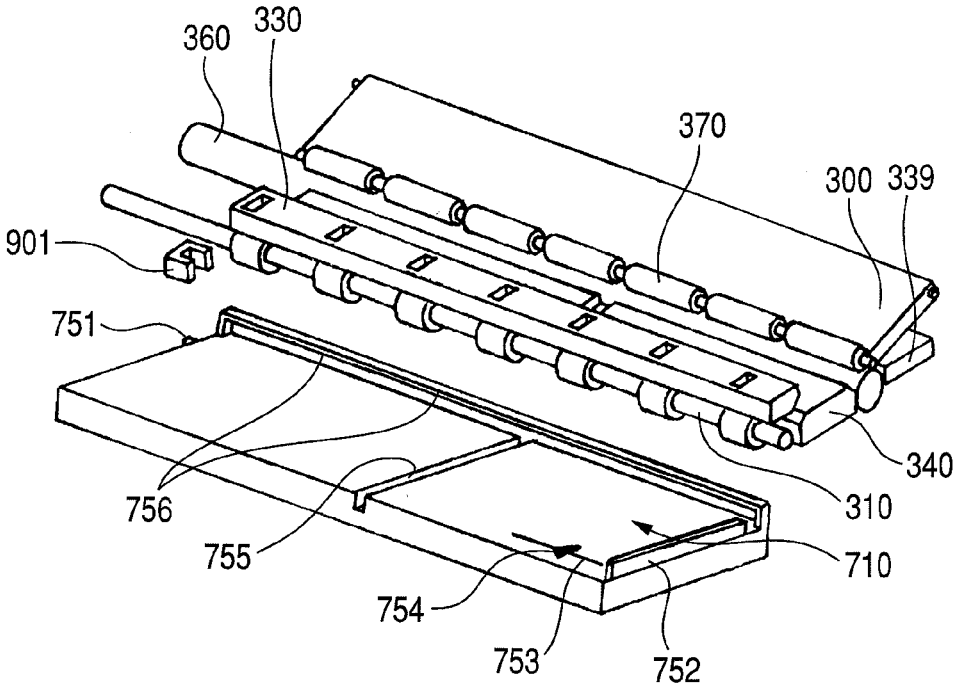
FIG. 5A is a perspective view when a feed/output tray is at a first position for normal recording.
Figure 5B:
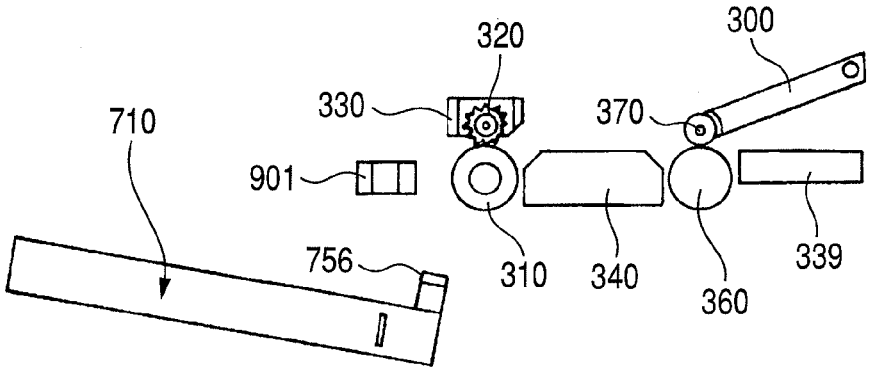
FIG. 5B is a longitudinal sectional view when the feed/output tray is at the first position for normal recording.
Figure 6:
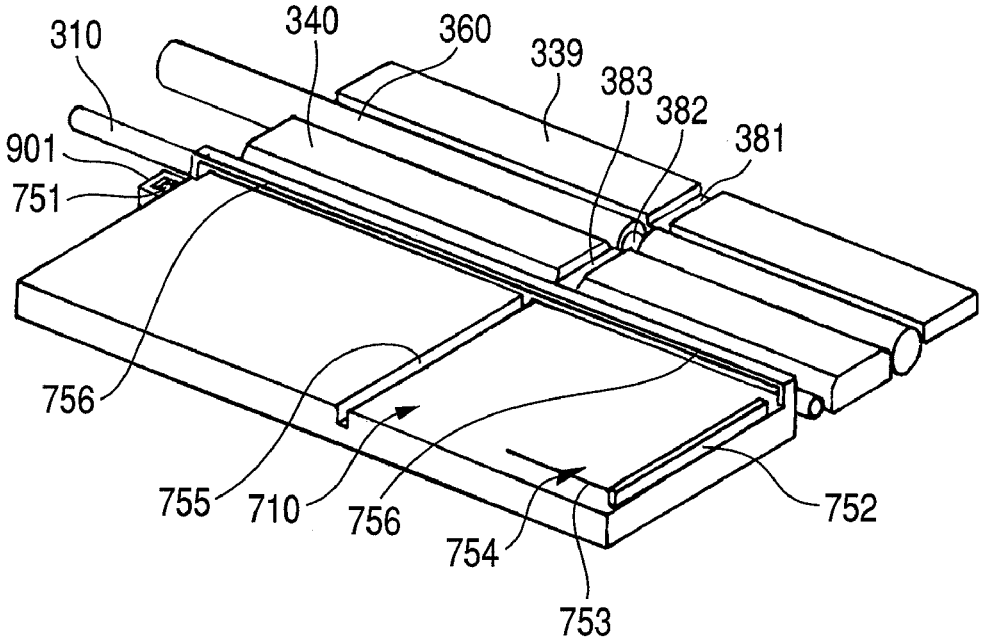
FIG. 6 is a perspective view of a structure below a paper passing unit when the feed/output tray is at a second position.
Figure 7:
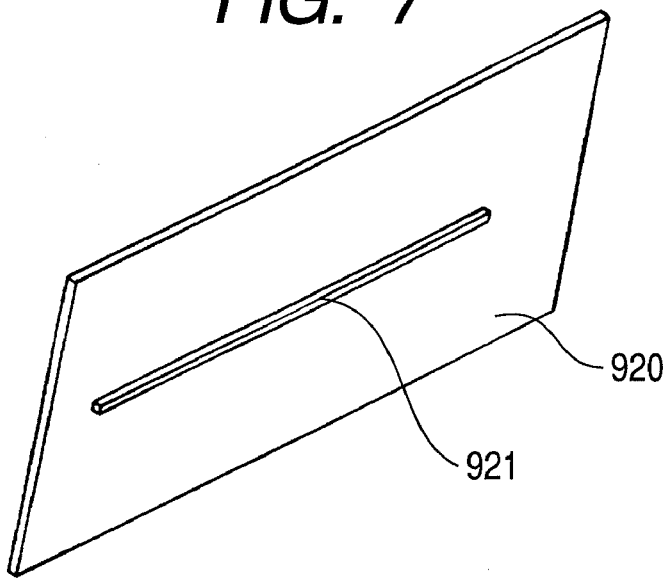
FIG. 7 is a perspective view of a disc tray as seen from its underside.
Figure 8A:
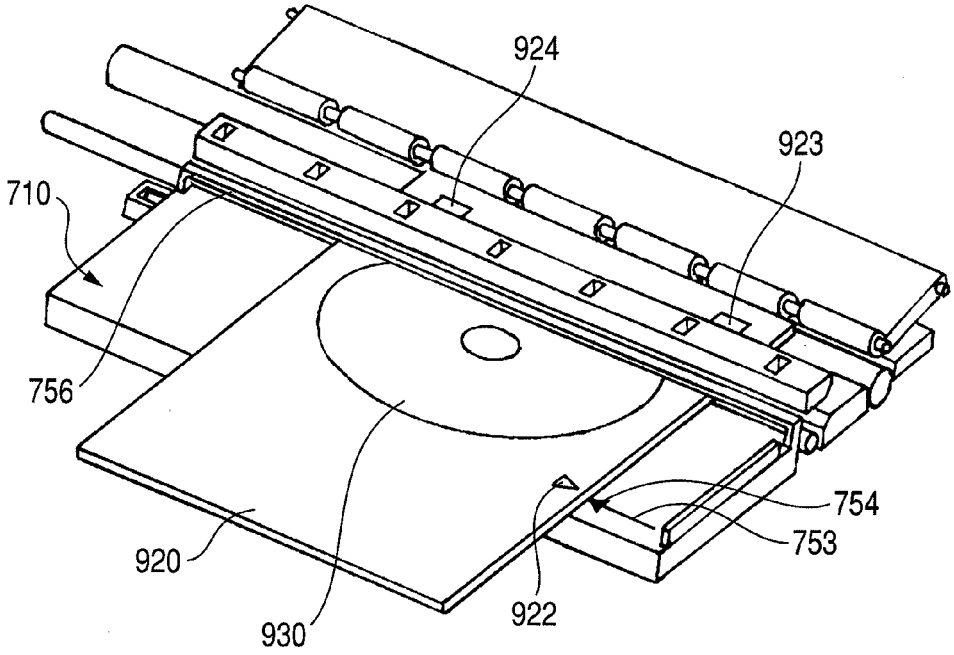
FIG. 8A is a perspective view when recording onto a recording medium set on the disc tray.
Figure 8B:
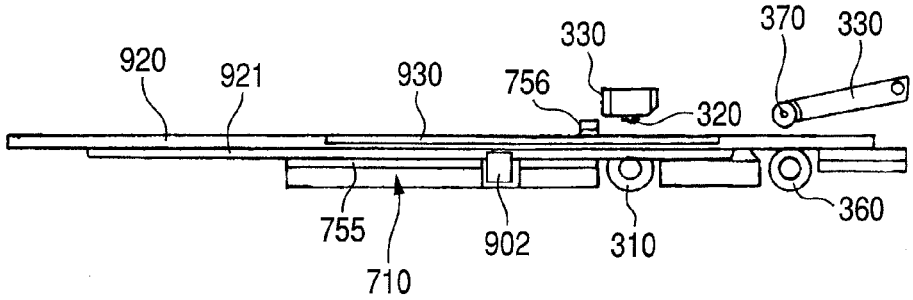
FIG. 8B is a longitudinal sectional view when recording onto the recording medium set on the disc tray.
Figure 9:
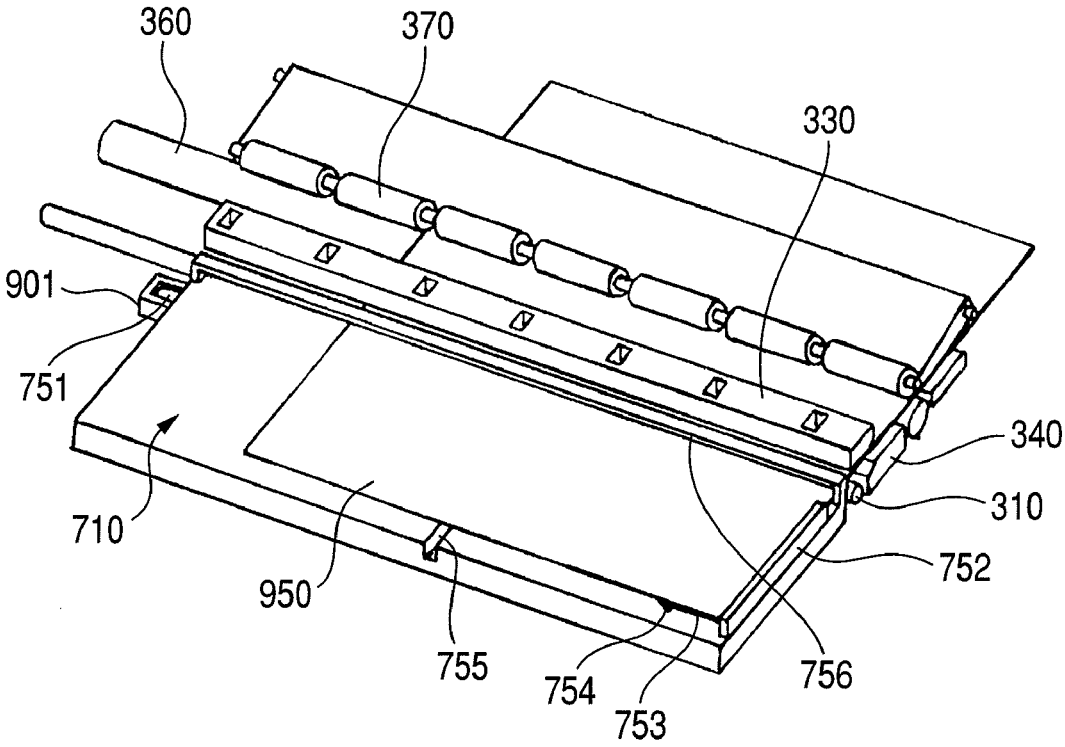
FIG. 9 is a perspective view when a recording medium is positioned on the feed/output tray in flat path recording.
Figure 10:
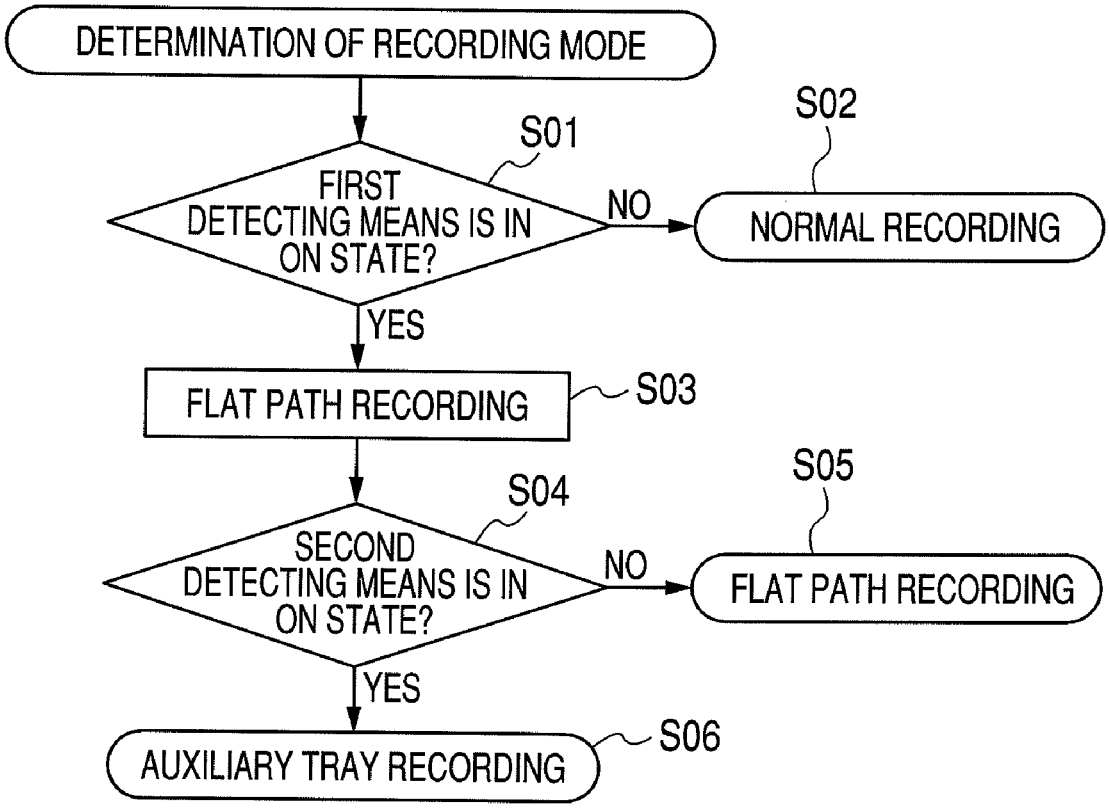
FIG. 10 is a flowchart of switching control between normal recording and flat path recording.
Figure 11A:
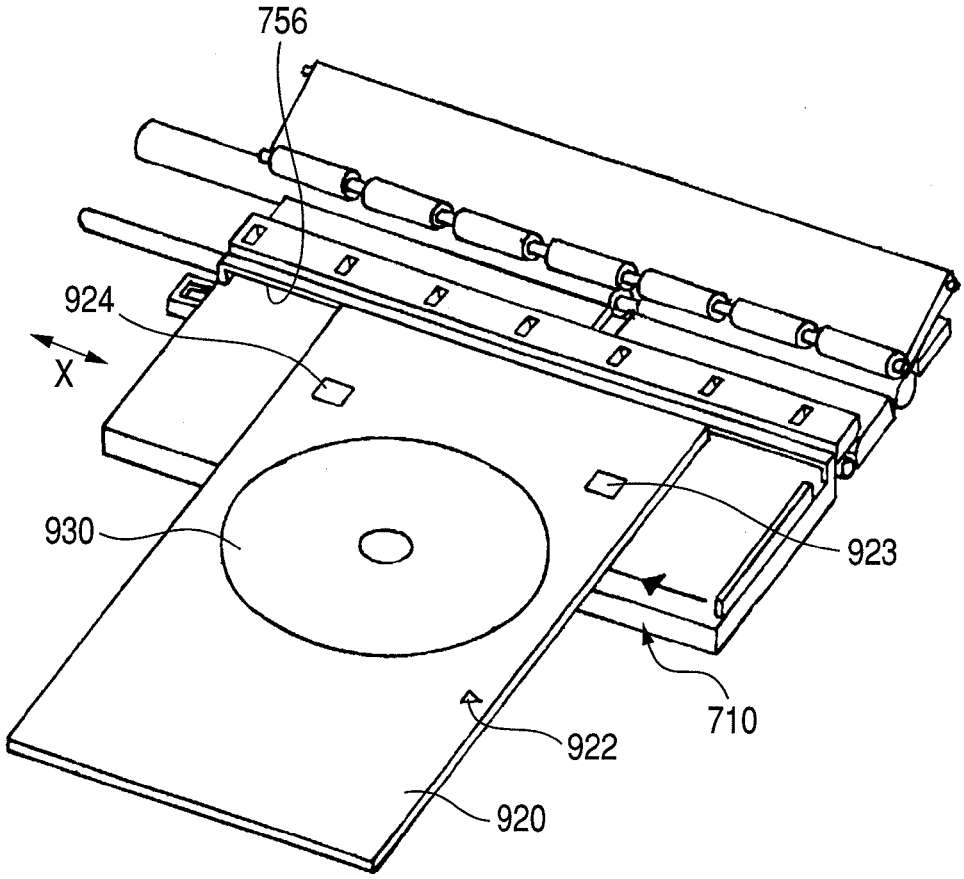
FIG. 11A is a perspective view when the disc tray is set at a wrong position on the feed/output tray.
Figure 11B:
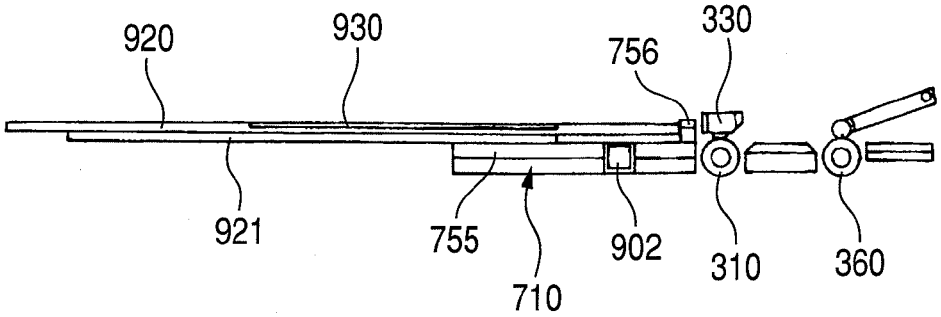
FIG. 11B is a longitudinal sectional view when the disc tray is set at the wrong position on the feed/output tray.

FIG. 5A is a perspective view when the feed/output tray is at a first position for normal recording. FIG. 5B is a longitudinal sectional view when the feed/output tray is at the first position for normal recording. FIG. 6 is a perspective view of a structure below a paper passing unit when the feed/output tray is at a second position for flat path recording. FIG. 7 is a perspective view of the disc tray as seen from its underside. FIG. 8A is a perspective view when recording onto a recording medium set on the disc tray. FIG. 8B is a longitudinal sectional view when recording onto the recording medium set on the disc tray. FIG. 9 is a perspective view when a recording medium is positioned on the feed/output tray in flat path recording. FIG. 10 is a flowchart of switching control between normal recording and flat path recording. FIG. 11A is a perspective view when the disc tray is set at a wrong position on the feed/output tray. FIG. 11B is a longitudinal sectional view when the disc tray is set at the wrong position on the feed/output tray.

In the recording apparatus according to this embodiment, a disc tray 920 on which a recording medium 930 (FIG. 8A) is set is inserted from the feed/output tray 710 located on the front of the apparatus, into the flat path. Recording is then performed on the recording medium 930 by the recording head 110 when the disc tray 920 is switchback-conveyed in the flat path in the direction opposite to the inserting direction. The feed/output tray 710 in this embodiment has a tray function of inserting the disc tray 920 and a tray function of receiving the output disc tray. The feed/output tray 710 is also used to receive and hold a recording medium which is fed by the feeding roller 280, subjected to normal recording by the recording head 110, and output. Note that flat path recording can also be realized according to a one-way type of manually feeding a recording medium from an opening (below the feeding means) on the back of the apparatus main body and outputting, from the front of the apparatus, the recording medium recorded by the recording head 110 while being conveyed through the flat path.

In normal recording, the feed/output tray 710 serves as an output tray on which several tens of recording media can be loaded, so that the feed/output tray 710 is located at the first position lower than the output opening 315 of the output means. In flat path recording, however, to horizontally feed a recording medium from the output opening 315 into the apparatus, the feed/output tray 710 needs to be moved up to the second position which is at the same height as the output opening. This output opening 315 is an entrance and exit of the flat path. Thus, the feed/output tray 710 is movable between the first position and the second position. Whether the feed/output tray 710 is located at the first position or the second position is detected by a tray flag 751 and a photosensor 901 (FIGS. 5A and 11) as a first detecting means. Determination as to whether the recording mode is a flat path recording mode or a normal recording mode is made by a detection signal of the first detecting means, and one of the recording modes is selected based on the detection signal. Hence, in the recording apparatus according to this embodiment, the feed/output tray 710 is used in both normal recording and flat path recording with no need for removal.

Figure 4:
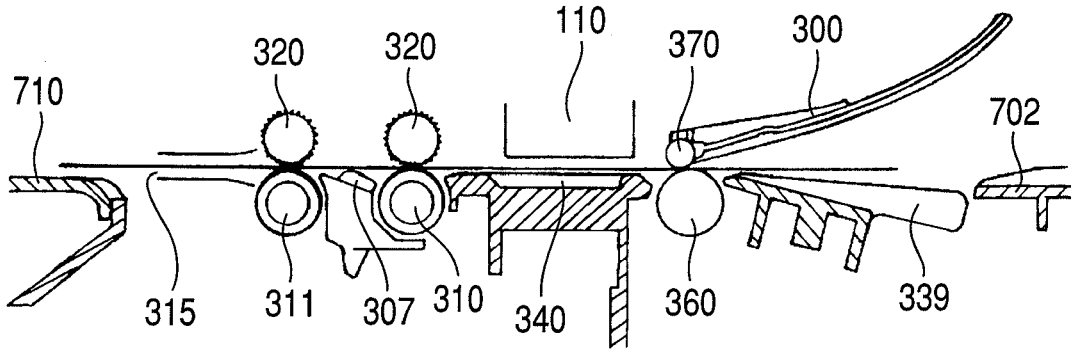
FIG. 4 is a longitudinal sectional view of the recording apparatus when recording onto a recording medium through the flat path.

In flat path recording that records onto a thick recording medium or an inflexible recording medium, the recording medium (including the disc tray 920 on which the recording medium is set) is switchback-conveyed along the flat path which is level as illustrated in FIG. 4. This being so, the second position of the feed/output tray 710 is at the same height as the flat path illustrated in FIG. 4. Moreover, since recording is performed onto a thick recording medium or an inflexible recording medium in the flat path recording mode, there is a case where a larger gap than in normal recording is required between the recording head 110 and the platen 340. In such a case, the recording head 110 is moved up. The up and down movement of the recording head 110 is carried out by moving up and down the guide shaft 420 which supports the carriage 400, using a carriage lifting mechanism composed of pivot cams and the like provided at both ends of the guide shaft 420. This allows the distance between the recording head 110 and the platen 340 to be adjusted.

In the flat path recording mode, first the disc tray 920 on which the recording medium 930 is mounted or a rigid recording medium 950 is set on the feed/output tray 710 and inserted into the apparatus. This inserting operation is started by operating a flat path key 304 arranged on the outer covering unit. In the inserting operation, the spur holder 330 and the pinch roller holder 300 are lifted up so that the spurs 320 and the pinch roller 370 are moved away to a position higher than a thickness of the recording medium. This is intended to sandwich a thick recording medium or an inflexible recording medium when the recording medium is inserted to a predetermined position inside the apparatus. A hook is provided on the feed/output tray 710, and the feed/output tray 710 is set at a flat path feed/output position (second position) which is at the same height as the output opening 315, by this hook.

Figure 3A:
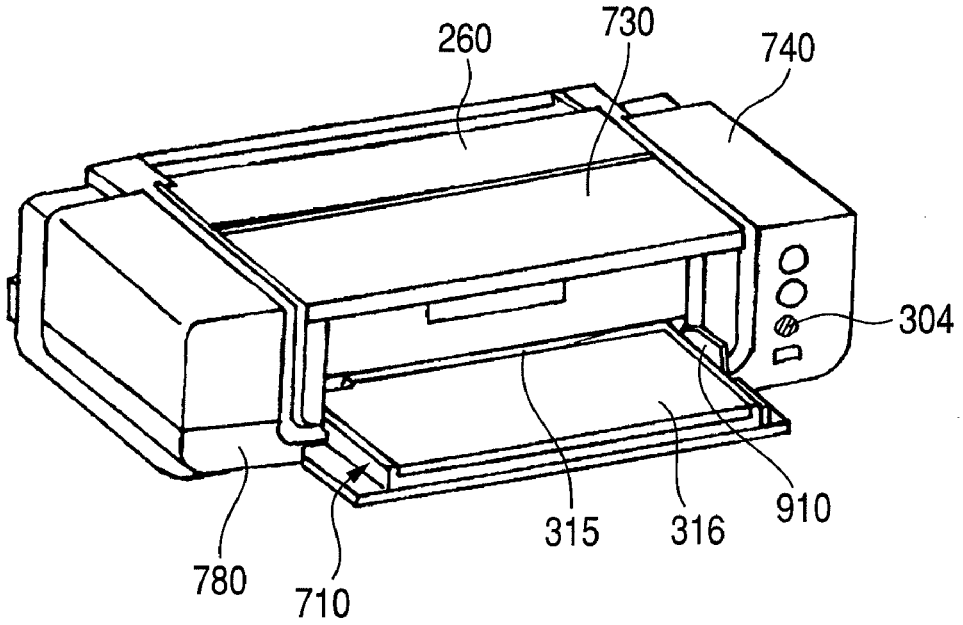
FIG. 3A is a front perspective view of the recording apparatus that enables recording using a flat path to be performed.
Figure 3B:
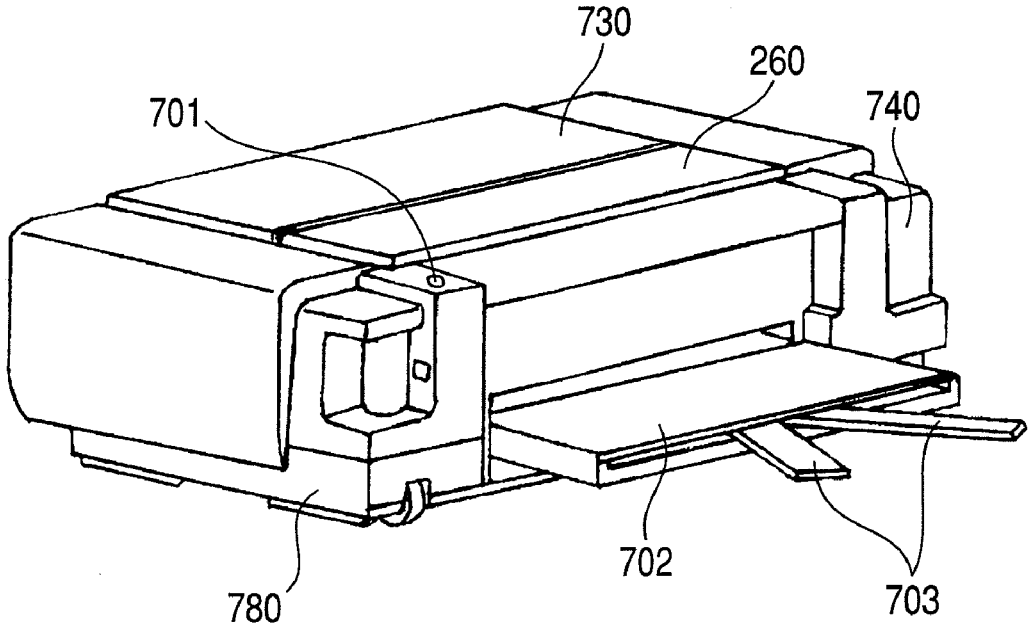
FIG. 3B is a back perspective view of the recording apparatus when using the flat path.

As illustrated in FIG. 3B, by pressing a rear tray button 701, a rear tray 702 provided on the back of the apparatus can be opened, and further a rear sub tray 703 can be opened in the shape of the letter V. There is a case where, when a long recording medium is inserted from the front of the apparatus, the recording medium protrudes from the back of the apparatus. The rear tray 702 and the rear sub tray 703 function to support the recording medium in such a case. In the case of a thick recording medium, unless the recording medium is kept in a flat posture during recording, there is a possibility that the recording medium rubs against the recording head or a conveying load varies, resulting in a decrease in image quality. Therefore, the trays protruding from the back of the apparatus are effective when flat path recording is performed on a long recording medium. Note that these trays need not be opened in the case of a recording medium of such a length that does not stick out of the back of the apparatus.

As a result of the above-mentioned operation, the recording medium (including the disc tray on which the recording medium is set) becomes insertable into the flat path from the output opening 315. The user therefore sets the recording medium on the feed/output tray 710, while aligning a back end (near side end) and a right end edge of the recording medium with marked positions on the feed/output tray 710. The user then operates the flat path key 304 again to lower the spur holder 330, so that the recording medium is sandwiched between the spurs 320 and the first output roller 310 and the second output roller 311. Next, the output rollers 310 and 311 are rotated in a direction opposite to that of normal recording so as to pull the recording medium into the apparatus, as a result of which the recording medium is inserted. A distance of pulling the recording medium is a distance at which a back end of a shortest recording medium reaches the conveying roller 360. When the recording medium reaches the conveying roller 360 in the above manner, the pinch roller holder 300 is lowered to sandwich the recording medium between the conveying roller 360 and the pinch roller 370. The conveying roller 360 is then rotated in the opposite direction, to convey the recording medium backward in the inserting direction until the back end of the recording medium is sandwiched between the conveying roller 360 and the pinch roller 370. Thus, the recording medium is set at a recording standby position.

A sandwiching force by nipping between the spurs 320 and the output rollers 310 and 311 is set to be comparatively weak so that an output operation in normal recording does not adversely affect a recorded image. This raises the possibility that the recording medium is displaced at the start of recording in flat path recording. In this embodiment, however, the recording medium is sandwiched by nipping between the conveying roller 360 and the pinch roller 370 having a comparatively high sandwiching force, and accordingly the recording medium can be set at an accurate position. Moreover, a PE sensor 307 (FIG. 4) in the flat path is disposed between the platen 340 and the spur holder 330. Therefore, when inserting the recording medium into the apparatus by a predetermined amount, the insertion position of the recording medium can also be managed with high accuracy by detecting the back end position (the front end position in the case of recording in feedback conveyance) of the recording medium with the PE sensor 307.

Having set the recording medium (including the disc tray on which a storage medium is set) at the recording standby position, a recording command is executed. That is, the conveying roller 360 is rotated in a normal direction which is a direction of conveyance in normal recording, to feedback-convey the recording medium to a recording start position by the recording head 110. Subsequently, an image is formed onto the recording medium by the same recording operation as in normal recording. The recorded recording medium is output to the feed/output tray 710 that is set at the second position of the same height as the exit (output opening 315) of the flat path.

In the case of performing flat path recording on the second recording medium following the first recording medium, the recorded recording medium is removed from the feed/output tray 710, the next recording medium is set on the feed/output tray 710, and the above-mentioned operation is repeated. In detail, this begins with the operation of pressing the above-mentioned flat path key 304 to lift up the spur holder 330 and the pinch roller holder 300 and thereby cause the spurs 320 and the pinch roller 370 to move away. In the case of ending flat path recording, on the other hand, the recording mode can be returned to the normal recording mode by moving the feed/output tray 710 from the second position (upper position) to the first position (lower position).

When the feed/output tray 710 is at the first position for normal recording, the feed/output tray 710 functions as an output tray that receives a recording medium output through the conveying roller 360, the platen 340, and the output rollers 310 and 311. In this state, the first detecting means 901 composed of a photosensor is in an OFF state, since there is no obstacle. When the user sets the displaceable feed/output tray 710 at the second position for flat path recording, the photosensor 901 is obstructed by the tray flag 751 and becomes an ON state. Thus, the flat path as illustrated in FIGS. 4 and 6 is formed.

In the flat path recording mode, the feed/output tray 710 functions as both a feed tray and an output tray. In flat path recording, recording can be performed on not only thick recording paper such as board or a rigid recording medium, but also the recording medium (e.g. a storage medium such as a CD-R) 930 set on the disc tray 920. That is, in flat path recording, a highly rigid recording medium or the disc tray 920 on which the storage medium 930 such as a CD-R is set is set on the feed/output tray 710 as the recording medium, and inserted into the flat path from the feed/output tray 710. Recording is then performed by the recording head 110 when switchback-conveying the recording medium in the direction opposite to the inserting direction. The recorded recording medium is output back onto the feed/output tray 710.

Accordingly, a side guide 752 along which one end edge of a recording medium such as cardboard is positioned and a line index 753 for positioning a back end of the recording medium to be set are provided on the feed/output tray 710. The side guide 752 and the line index 753 constitute a positioning means for a recording medium such as cardboard. Furthermore, a triangle index 754 for positioning the disc tray in the feeding direction and a guide groove 755 for positioning the disc tray 920 in the width direction are provided on the feed/output tray 710 as a positioning means for setting the disc tray 920.

The flat path forms a flat conveying path where the guide flapper 339, the conveying roller 360, the output rollers 310 and 311, and the feed/output tray 710 are arranged in the horizontal direction with reference to an upper surface of the platen 340. Here, a guide flapper groove 381, a conveying roller groove 382, and a platen groove 383 are formed respectively in the guide flapper 339, the conveying roller 360, and the platen 340 at positions (positions on the extended line in the conveying direction) corresponding to the guide groove 755 of the feed/output tray 710. In addition, non-rubber portions of the output rollers 310 and 311 coincide with (correspond to) the position of the guide groove 755.

A width dimension of the disc tray 920 is smaller than a maximum width of a recordable recording medium. As illustrated in FIG. 7, a guide rib 921 extending in the conveying direction is formed on the underside of the disc tray 920. This provides a positioning means that can fix the position of the disc tray 920 in the width direction (direction intersecting the conveying direction), by engaging the guide rib 921 with the guide groove 755 of the feed/output tray 710. The guide flapper groove 381, the conveying roller groove 382, and the platen groove 383 each have an undercut cross section to avoid contact with the guide rib 921. In this way, the disc tray 920 can be kept from being contacted and obstructed during conveyance.

A recording operation on the storage medium 930 set on the disc tray 920 as the recording medium is described in detail below. This is flat path recording, but is also referred to as disc tray recording since the disc tray is used. First, the inflexible storage medium 930 such as a CD-R or a DVD-R is positioned and mounted on the disc tray 920. Here, the feed/output tray 710 is at the second position horizontal to the flat path. The disc tray 920 is set on the feed/output tray 710 as illustrated in FIGS. 8A and 8B. When doing so, the disc tray 920 is positioned by engaging the guide rib 921 of the disc tray 920 with the guide groove 755 of the feed/output tray 710. Because the spurs 320 and the pinch roller 370 are in an open state as a result of being moved up, the disc tray 920 can be easily inserted into the apparatus.

To insert the disc tray 920 on which the recording medium 930 is set from the feed/output tray 710 located on the front of the apparatus, first the disc tray 920 is inserted until its triangle index 922 coincides with the triangle index 754 of the feed/output tray 710. This causes a photosensor 902 attached to the feed/output tray 710 as a second detecting means, to be obstructed by the guide rib 921 of the disc tray 920 and become an ON state. The setting of the disc tray 920 on the feed/output tray 710 is detected based on a resulting ON signal, and the recording mode shifts to the disc tray recording mode. When a recording start instruction is made, the position of the recording medium 930 is detected by a photosensor on the carriage 400 using reflectors 923 and 924 on the disc tray 920, and a recording area corresponding to an outline of the recording medium 930 is set. After this, recording is performed on the recording medium 930 while switchback-conveying the disc tray 920 in the direction opposite to the inserting direction. During this time, though the disc tray 920 is conveyed by the conveying roller 360, its posture and position are regulated by the engagement between the guide rib 921 and the guide groove 755, so that no inclination occurs.

An operation of recording onto a thick recording medium such as board or highly rigid recording medium 950 by flat path recording without using the disc tray 920 is described below. As illustrated in FIG. 9, the recording medium 950 is set on the feed/output tray 710 at the position where its end edge butts against the side guide 752. Since the spurs 320 and the pinch roller 370 are in an open state as a result of being moved away upward, the recording medium 950 can be easily inserted into the apparatus. The recording medium 950 is inserted until its back end coincides with the line index 753. Because nothing engages with the guide groove 755 of the feed/output tray 710, the photosensor 902 which is the second detecting means is in an OFF state without being obstructed. When a recording start instruction is made, the recording medium 950 is conveyed backward into the apparatus so as to reach the recording start position. Following this, an image is recorded by the recording head 110, while switchback-conveying the recording medium 950 in the direction opposite to the inserting direction by rotating the conveying roller 360 in the normal direction. The recorded recording medium 950 is output back onto the feed/output tray 710.

Switching control of each recording mode mentioned above is described below, with reference to FIG. 10. When the first detecting means 901 is in an OFF state in step S01, the operation proceeds to step S02, where the normal recording mode is executed for a recording medium fed by the feeding roller 280 in the feeding unit. In the normal recording mode, the feed/output tray 710 is at the lower first position and functions as an output tray. When the first detecting means 901 is in an ON state in step S01, the operation proceeds to step S03, where flat path recording is selected and the recording mode shifts to the flat path recording mode. In the flat path recording mode, the feed/output tray 710 is moved to the second position at the same height as the output opening 315. The operation then proceeds to step S04 to determine whether or not the second detecting means 902 is in an ON state. When the second detecting means 902 is not in an ON state, the operation proceeds to step S05, where flat path recording is performed for a thick recording medium such as board or a highly rigid recording medium. When the second detecting means 902 is in an ON state in step S04, on the other hand, the operation proceeds to step S06, where the disc tray recording mode of recording onto the recording medium 930 set on the disc tray 920 is selected and executed. Such recording mode selection and switching are controlled by a main substrate 960 located on the apparatus main body.

The following describes the case where the disc tray 920 is not set at a correct position on the feed/output tray 710, with reference to FIGS. 11A and 11B. A regulating means 756 for preventing the disc tray 920 from being inserted at a position other than a set predetermined position in the direction intersecting the conveying direction (in the width direction of the recording medium) is provided on the apparatus main body side of the feed/output tray 710. For instance, this regulating means 756 can be realized by an entry regulating unit formed in the shape of the horizontal bar 756 that is placed along the end of the feed/output tray 710 on the apparatus main body side so as to be away from the upper surface of the tray 710. A gap between the horizontal bar 756 and the upper surface of the tray 710 is larger than the thickness of the disc tray 920, and smaller than the sum of the thickness of the disc tray 920 and the height of the guide rib 921. Both ends of the horizontal bar 756 are attached to the feed/output tray 710. The regulating means may have other structures, so long as it can prevent the insertion of the disc tray 920.

When the disc tray 920 is set correctly on the feed/output tray 710, the guide rib 921 engages with the guide groove 755, and the lower surface of the disc tray 920 is in contact with the upper surface of the feed/output tray 710, as illustrated in FIG. 8B. A distance between the upper surface of the disc tray 920 and the feed/output tray 710 is the thickness of the disc tray 920. Therefore, the disc tray 920 can be inserted into the apparatus main body from the gap between the horizontal bar 756 and the tray 710, without striking the horizontal bar 756.

When the user inserts the disc tray 920 onto the feed/output tray 710, there is a case where the disc tray 920 is inserted at a position deviating in the width direction (the direction of the two-directional arrow X in FIG. 11A) of the recording medium, that is, at a position where the guide rib 921 does not match the guide groove 755. In such a case, even when the user tries to insert the disc tray 920, the front end of the disc tray 920 collides with the horizontal bar 756 constituting the regulating means because the gap between the upper surface of the feed/output tray 710 and the horizontal bar 756 is smaller than the sum of the thickness of the disc tray 920 and the height of the guide rib 921. Thus, the insertion of the disc tray 920 from the front of the apparatus is prevented. According to this structure, even when the disc tray 920 is inserted at a wrong position, it is possible to avoid a problem caused by wrongly determining the recording medium as recording paper such as board, for example, a collision of the disc tray 920 with the recording head 110.

In this embodiment, the horizontal bar 756 is provided on the feed/output tray 710 as the regulating means for preventing the insertion of the disc tray 920. However, the horizontal bar 756 may instead be provided on other parts such as the spur holder 330, the pinch roller holder 300, and the like. Moreover, in this embodiment, the feed/output tray 710 used in flat path recording has the function as an output tray in normal recording. Alternatively, the output tray for normal recording and the feed/output tray for flat path recording may be movably provided so as to switch between them according to the recording mode. In other words, a modification may be made to execute the normal recording mode in a state of housing the feed/output tray, and execute the flat path recording mode (including the disc tray recording mode) in a state of pulling the feed/output tray out to a use position.

As described above, a recording apparatus including a feed/output tray that can be used, with no need for removal, both in the case of recording using a disc tray on which a recording medium is set and in the case of recording without using the disc tray (including both normal recording and flat path recording) is provided. That is, a feed/output tray that can be used in both flat path recording and normal recording without no need for removal is provided. This contributes to improved operability in flat path recording, and a decrease in apparatus cost. Moreover, the insertion of the disc tray 920 on which a recording medium is set is prevented unless the disc tray 920 is situated at the predetermined position on the feed/output tray 710. Hence, problems such as a decrease in quality of a recorded image and apparatus damage due to a wrong recording operation can be eliminated.

Second Embodiment

Figure 12:
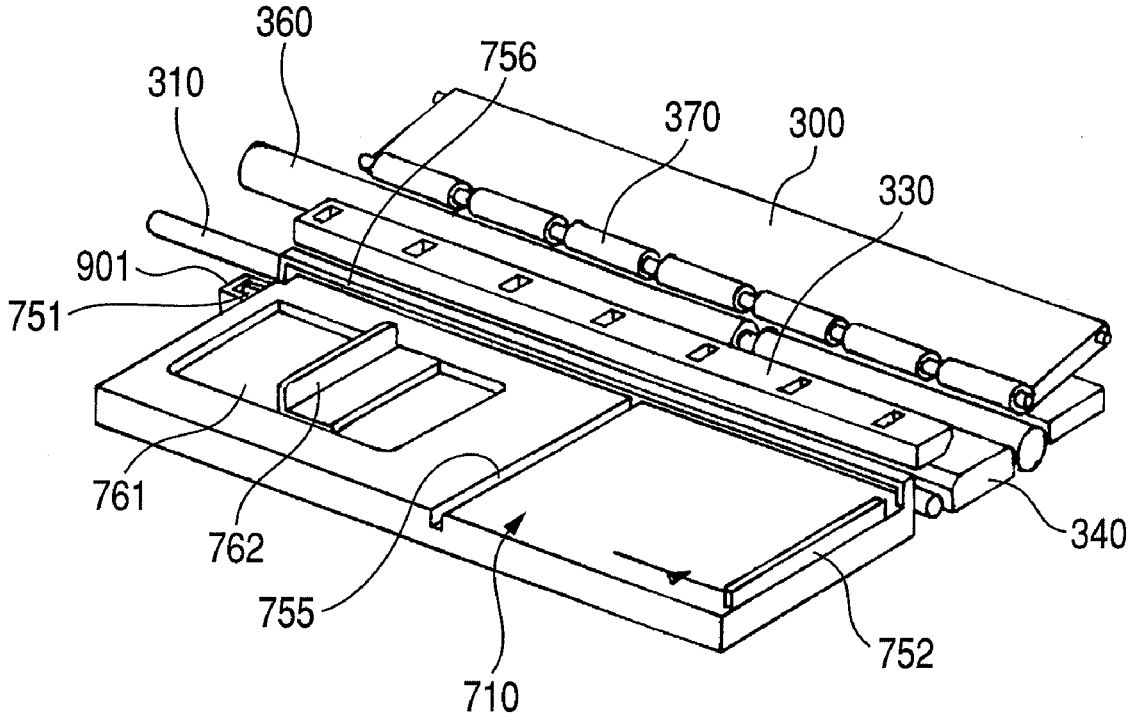
FIG. 12 is a perspective view when a feed/output tray according to a second embodiment is at the second position for flat path recording.

FIG. 12 is a perspective view when a feed/output tray according to a second embodiment is at the second position for flat path recording. In this embodiment, in addition to the fixed side guide 752, a movable side guide 762 that is movable (positionally adjustable) in the width direction of the recording medium is provided on the feed/output tray 710 in opposition to the fixed side guide 752. The movable side guide 762 is installed in a side guide housing unit 761 formed on the upper surface of the feed/output tray 710, in a state of being movable in the width direction of the recording medium. According to this structure, the position of the recording medium inserted from the feed/output tray 710 can be regulated at both end edges, and also the insertion and conveyance into the flat path can be guided. Though this embodiment differs from the first embodiment in the above-mentioned point, the structures in the other points are the same as the first embodiment. Accordingly, the corresponding parts are indicated by the same reference signs and their description is omitted.

According to the second embodiment, the following effects can be obtained in addition to the same effects as the first embodiment. Which is to say, when recording onto a recording medium such as board in the flat path recording mode, the position of the recording medium in the width direction can be reliably regulated from both sides, by adjusting the position of the movable side guide 762 in accordance with the paper width. Such regulation allows the recording medium to be conveyed with high accuracy without inclination and the like, as a result of which favorable image recording can be carried out. Moreover, in the normal recording mode, paper output can be performed without obstruction by moving the movable side guide 762 aside to the left end in the drawing. Furthermore, since the width dimension of the disc tray 920 is smaller than the maximum width dimension of a recordable recording medium, the disc tray recording mode that records onto a recording medium such as a CD-R set on the disc tray 920 can be executed in the same manner as in the first embodiment described above.

Though the above embodiments describe an example of a serial-type recording apparatus that forms an image by reciprocating a recording head, the present invention is equally applicable to a line-type recording apparatus that forms an image on one line at a time only by paper feed.

Though the above describes label printing of an optical disc, but the present invention can also be used as an apparatus that performs label printing on an ID card or an IC card. In this case, a card tray for conveying a card is used as a media tray on which a recording medium is set.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-150478, filed Jun. 9, 2008, which is hereby incorporated by reference herein its entirety.

What is claimed is:

1. A recording apparatus comprising:

a media tray on which a recording medium is mounted, and which has a rib along an inserting direction into a main body of the recording apparatus, the rib being formed on a surface of the media tray opposite to a surface of the media tray on which the recording medium is mounted;

a feed tray on which the media tray is set, and which has a groove along the inserting direction, the groove being engageable with the rib; and a regulating member which regulates a height from the feed tray when the media tray is inserted into the main body of the recording apparatus, wherein the regulated height is a height that prevents the insertion of the media tray into the main body of the recording apparatus in a state where the rib of the media tray does not engage with the groove of the feed tray.

2. The recording apparatus as claimed in claim 1, wherein after one of the recording medium mounted on the media tray and a recording medium directly set on the feed tray is inserted in the inserting direction, recording is performed when the inserted recording medium is conveyed in a direction opposite to the inserting direction.

3. The recording apparatus as claimed in claim 1, further comprising a feeding unit which does not use the feed tray, wherein the feed tray is used as an output tray in a case of recording onto a recording medium fed from the feeding unit.

4. The recording apparatus as claimed in claim 3, wherein the feed tray is movable between a first position at which the feed tray is used as the output tray and a second position at which the feed tray is used as the feed tray.

5. The recording apparatus as claimed in claim 4, further comprising:

a first detecting means which detects a position of the feed tray; and a second detecting means which detects that the media tray is set on the feed tray, wherein in a case where the first detecting means detects that the feed tray is at the second position and the second detecting means detects that the media tray is set on the feed tray, the recording medium is fed using the media tray to perform recording.

6. The recording apparatus as claimed in claim 5, wherein in a case where the first detecting means detects that the feed tray is at the second position and the second detecting means does not detect that the media tray is set on the feed tray, a recording medium directly set on the feed tray is fed to perform recording.

* * * * *